US009759476B2

(12) United States Patent
Bazzucchi

(10) Patent No.: US 9,759,476 B2
(45) Date of Patent: Sep. 12, 2017

(54) REFRIGERATING APPLIANCE WITH A PASSAGE FOR A FLEXIBLE TUBULAR ELEMENT BETWEEN CABINET AND DOOR

(71) Applicant: INDESIT COMPANY S.P.A., Fabriano (IT)

(72) Inventor: Valter Bazzucchi, Fabriano (IT)

(73) Assignee: Indesit Comppany S.p. A., Fabriano (IT)

( * ) Notice: Subject to any disclaimer, the term of this patent is extended or adjusted under 35 U.S.C. 154(b) by 0 days.

(21) Appl. No.: 14/913,452

(22) PCT Filed: Sep. 2, 2014

(86) PCT No.: PCT/IB2014/064197

§ 371 (c)(1),
(2) Date: Feb. 22, 2016

(87) PCT Pub. No.: WO2015/029000

PCT Pub. Date: Mar. 5, 2015

(65) Prior Publication Data

US 2016/0201975 A1 Jul. 14, 2016

(30) Foreign Application Priority Data

Sep. 2, 2013 (IT) ..... TO2013A0710

(51) Int. Cl.
*F25D 23/02* (2006.01)
*E05D 11/00* (2006.01)
(Continued)

(52) U.S. Cl.
CPC ..... *F25D 23/028* (2013.01); *A47L 15/4261* (2013.01); *E05D 11/0054* (2013.01);
(Continued)

(58) Field of Classification Search
CPC .... F25D 23/028; F25D 23/061; F25D 23/065; F25D 23/068; F25D 2317/00;
(Continued)

(56) References Cited

U.S. PATENT DOCUMENTS 2,148,787 A 2/1939 Thomas
2,522,989 A * 9/1950 Carbary ..... H01R 35/02 16/221
(Continued)

FOREIGN PATENT DOCUMENTS

DE WO 2005108725 A1 * 11/2005 ..... E05D 11/00
DE 202008006133 U1 11/2008
(Continued)

OTHER PUBLICATIONS

Search Report and Opinion, mail date Apr. 9, 2014 re: Italian Patent Application No. T020130710, filing date: Sep. 2, 2013, Applicant: Indesit Company SPA.
(Continued)

*Primary Examiner* — Andrew Roersma

(57) ABSTRACT

A refrigerating appliance comprises a cabinet, at least one door, and at least one hinge allowing the door to rotate about an axis for opening and closing, and further comprising at least one bracket configured to support the hinge, and at least one flexible tubular element inserted on one side in the cabinet and on the other side in the door. The flexible tubular element is configured to exit through a top wall of the cabinet, and is further configured to enter a cavity of the door by passing through a slot formed in the top wall of the door. The slot partially surrounds the hinge, and the slot is partially under the bracket when the door is closed.

10 Claims, 6 Drawing Sheets

(51) Int. Cl.
*F25D 23/06* (2006.01)
*A47L 15/42* (2006.01)

(52) U.S. Cl.
CPC ..... *E05D 11/0081* (2013.01); *F25D 23/061* (2013.01); *F25D 23/068* (2013.01); *E05Y 2400/654* (2013.01); *E05Y 2900/31* (2013.01); *F25D 2317/00* (2013.01); *F25D 2323/024* (2013.01); *F25D 2400/40* (2013.01)

(58) Field of Classification Search
CPC ..... F25D 2323/02; F25D 2323/024; F25D 2400/18; F25D 2400/40; E05D 11/0054
See application file for complete search history.

(56) References Cited

U.S. PATENT DOCUMENTS

| | | | | | |
|---|---|---|---|---|---|
| 4,609,234 | A * | 9/1986 | Naniwa | E05D 3/022 | 16/341 |
| 5,568,712 | A * | 10/1996 | Jenkins | F25D 23/028 | 312/405 |
| 6,945,621 | B2 * | 9/2005 | Shin | E05D 3/18 | 16/359 |
| 7,617,634 | B2 * | 11/2009 | Leimkuehler | F25D 23/02 | 49/382 |
| 2004/0206106 | A1 * | 10/2004 | Lee | F25D 23/126 | 62/389 |
| 2005/0284159 | A1 * | 12/2005 | Kim | F25D 23/028 | 62/126 |
| 2010/0218547 | A1 * | 9/2010 | Rothmund | F25D 23/028 | 62/449 |

FOREIGN PATENT DOCUMENTS

| | | | | | |
|---|---|---|---|---|---|
| EP | 1191289 | A2 | | 3/2002 | |
| EP | 1624264 | A1 | | 2/2006 | |
| EP | 2058612 | A1 | | 5/2009 | |
| ES | WO 2010010033 | A1 | * | 1/2010 | E05D 11/0054 |
| ES | EP 2495516 | A2 | * | 9/2012 | F25D 23/028 |
| GB | 2252789 | A | | 8/1992 | |
| JP | H 08296952 | A | * | 11/1996 | F25D 23/00 |
| JP | 2001272162 | A | * | 10/2001 | F25D 23/00 |
| KR | GB 2401170 | A | * | 11/2004 | F25D 23/028 |
| KR | EP 2562497 | A2 | * | 2/2013 | E05D 11/0081 |
| NL | EP 1821052 | A2 | * | 8/2007 | F25D 23/02 |
| TR | WO 2004048865 | A1 | * | 6/2004 | E05D 7/02 |

OTHER PUBLICATIONS

International Publication No. WO2015029000A1 with International Search Report, publication date: Mar. 5, 2015, based on International Patent Application No. PCT/IB2014064197 filed Sep. 2, 2014, Applicant: Indesit Company S.P.A.
Written Opinion of International Searching Authority for PCT application No. PCT/IB2014064197 filed Sep. 2, 2014, Applicant: Indesit Company S.P.A.

* cited by examiner

REFRIGERATING APPLIANCE WITH A PASSAGE FOR A FLEXIBLE TUBULAR ELEMENT BETWEEN CABINET AND DOOR

BACKGROUND OF THE INVENTION

The present disclosure relates to a refrigerating appliance, in particular for household use, comprising a tubular element, such as a cable or a pipe, that connects the cabinet to the door of the refrigerating appliance.

SUMMARY OF THE INVENTION

The present disclosure provides a refrigerating appliance capable of solving some of the problems suffered by the prior art.

One object is to provide a refrigerating appliance that comprises a tubular connection element between the cabinet and the door, wherein the tubular element will not run the risk of suffering any damage when opening or closing the door.

Another object is to provide a refrigerating appliance wherein the door can be opened without being hindered by the tubular element, reaching opening angles well in excess of 90 degrees.

Another object is to provide a refrigerating appliance wherein the tubular element is accommodated in a compact fashion, so as to minimize the room it occupies with the door open and with the door closed.

Yet another object is to provide a refrigerating appliance wherein the tubular element has such a configuration that it can be easily assembled, thus improving the production and/or maintenance of the refrigerating appliance.

A refrigerating appliance is provided, the refrigerating appliance comprising a cabinet, at least one door, and at least one hinge allowing the door to rotate about an axis for opening and closing; the refrigerating appliance further comprises at least one bracket configured to support the hinge, and at least one flexible tubular element inserted on one side in the cabinet and on the other side in the door; the flexible tubular element is configured to exit through a top wall of the cabinet, and is further configured to enter a cavity of the door by passing through a slot formed in the top wall of the door, wherein the slot partially surrounds the hinge and is partially under the bracket when the door is closed.

The tubular element is protected when opening and closing the door, preventing the same from being stressed. Advantageously, the door can be opened without being hindered by the tubular element, reaching opening angles up to 150° and more. The flexible tubular element is accommodated in a compact fashion, so as to minimize the room it occupies with the door open and with the door closed.

Preferably, the slot extends from a region comprised between the hinge and the cabinet, when the door is closed, to a region external to the hinge with respect to the cabinet, when the door is open.

Preferably, the hinge is attached to the top wall of the door, and the slot has a semi-annular profile and is arranged around the hinge, its width being such as to allow the flexible tubular element to move along said semi-annular profile; preferably, the width of the slot is greater than the diameter of the flexible tubular element, so as to allow the latter to slide within the slot channel.

Preferably, the bracket is rigidly attached to the top wall of the cabinet, and is substantially flat and configured to be surmounted by the flexible tubular element, which crosses it before entering the slot formed in the top wall of the door.

Preferably, the bracket further comprises a profiled hole configured to allow the flexible tubular element to pass through it while exiting the top wall of the cabinet, at an upper front panel thereof.

Preferably, the flexible tubular element is configured to form a bend over the top wall at the bracket, towards the rear of the cabinet with respect to the door; the flexible tubular element comprises at least one connector that connects together two sections thereof in the region of the bend.

Preferably, the refrigerating appliance comprises an aesthetic cover for the bracket, which is shell-shaped and configured to receive a section of the flexible tubular element; said aesthetic cover is further configured to be coupled to the bracket, thereby creating a free passage for the flexible tubular element in the region where it enters the slot.

Preferably, the flexible tubular element comprises at least one connector that connects together two sections thereof, and the slot further comprises a recess adapted allow the passage of at least one element of the connector while assembling the appliance, wherein the recess is then covered with a small aesthetic plate.

Preferably, the door comprises a pair of respective slots on the top wall, on both the left and right sides, so as to allow the opening direction of the door to be reversed by differently mounting the flexible tubular element.

Typically, the flexible tubular element can be a pipe carrying a liquid or a sheath incorporating at least one electric cable to be connected, for example, to a display or to electric devices arranged in the door.

Further advantageous and particular aspects will become apparent from the following detailed description and from the dependent claims.

These and other features, advantages, and objects of the present invention will be further understood and appreciated by those skilled in the art by reference to the following specification, claims, and appended drawings.

BRIEF DESCRIPTION OF THE DRAWINGS

Some preferred and advantageous embodiments will now be described by way of non-limiting example with reference to the annexed drawings, wherein.

The drawings show different aspects and embodiments of the present invention and, where appropriate, similar structures, components, materials and/or elements are designated in the various drawings by the same reference numerals.

DETAILED DESCRIPTION

Common refrigerating appliances include refrigerators for household use; the following description will refer to said appliances, without the invention being however limited thereto.

Figure 1:
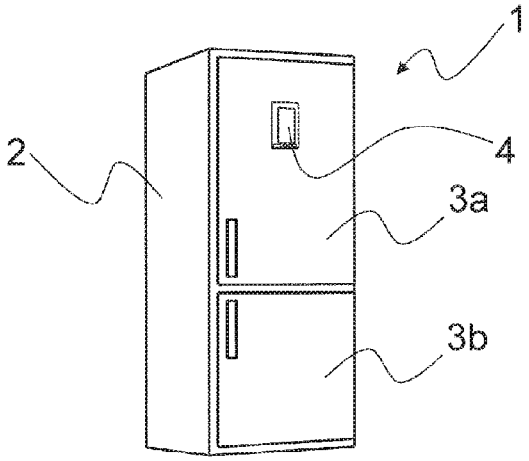
FIG. 1 schematically shows a refrigerating appliance according to the present invention.

FIG. 1 schematically shows a refrigerator 1 according to one aspect of the present disclosure. Said refrigerator 1 comprises a cabinet 2 placed on a base laid on the ground; typically, the walls of the cabinet comprise a thick layer of thermoinsulating material to ensure that the operating temperatures are maintained.

The refrigerator 1 comprises two refrigeration cells, wherein a first cell is used for fresh food and is arranged in the upper part of the cabinet 2, while a second cell is used for frozen food and is arranged in the lower part of the cabinet 2. The refrigerator 1 comprises two doors; in particular, there is an upper door 3*a* for the cell for fresh food, and a lower door 3*b* for the cell for frozen food.

The doors 3*a* and 3*b* of the refrigerator 1 are each connected to the cabinet by one or more hinges, which allow the doors to be opened and closed by the user through a rotary movement about a vertical axis. In the field of refrigerating appliances, hinges of various types are commonly used, which are generally known to those skilled in the art.

In this non-limiting example, the refrigerator 1 comprises a display 4 positioned on the outside of the door 3*a*. Through the display 4 the user can, for example, control the operation of the refrigerator by setting the operating temperature thereof. In general, a plurality of functions can be executed by means of the display 4 and its user interface, in accordance with the prior art.

It can therefore be appreciated that the display 4 requires, for its operation, a power connection, and preferably also a signal connection, that connect the display 4 to the main body of the cabinet 2, in which the electric and electronic devices that ensure the proper operation of the refrigerator 1 are typically found.

It is therefore apparent that the refrigerator 1 comprises a flexible tubular element for an electric cable, which connects the cabinet 2 to the door 3*a*. The electric cable may be used, for example, for supplying power to the display 4 and also to a light source mounted on the door 3*a* and facing towards the inside of the refrigerator, i.e. towards the upper refrigeration cell.

In the example shown in the drawing, the tubular element is a sheath containing multiple electric wires and/or signal wires for powering and controlling the display 4, e.g. a touchscreen-type display.

Alternatively, the tubular element may be, for instance, a pipe carrying a liquid, which connects the cabinet 2 to the door 3*a*. The said pipe may be used, for example, to supply a refrigerated water distributor mounted on the door 3*a* and facing outwards from the refrigerator. Other possible applications of the flexible tubular element will become apparent to those skilled in the art in the light of the present description and of the advantages deriving therefrom. Furthermore, alternative embodiments of the present disclosure may utilize multiple tubular elements, even different from one another, whether coupled in parallel or not.

Figure 2:
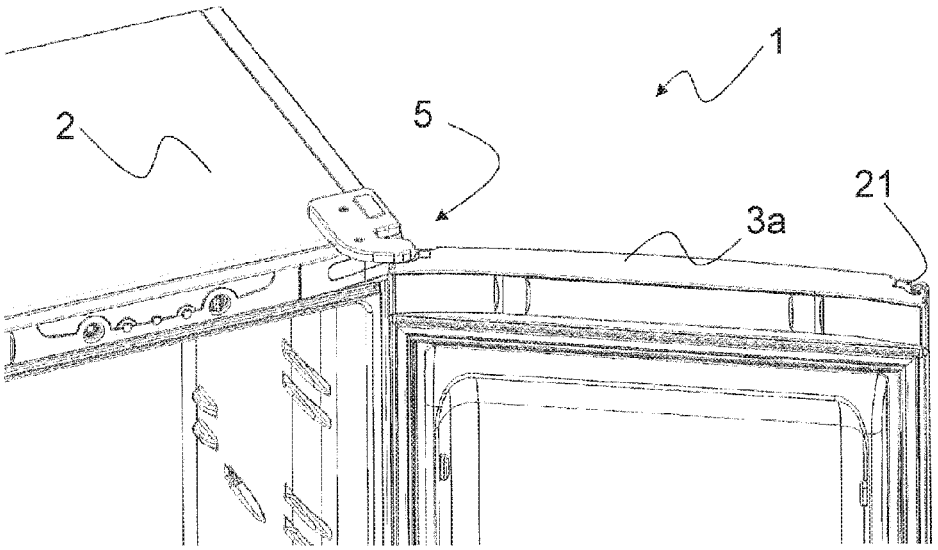
FIG. 2 shows the refrigerating appliance of FIG. 1 with the door open, in the region where the tubular element runs.

FIG. 2 schematically shows the refrigerator 1 with the door 3*a* open; this drawing clearly shows the path followed by the flexible tubular element, which runs in the region 5, near the upper hinge of the door 3*a*.

The refrigerator 1 comprises at least one hinge, which will be described below, with one axis of rotation allowing the door 3*a* to be opened with respect to the cabinet 2. The axis of rotation is substantially vertical in normal operating conditions of the refrigerator 1.

In this view of the refrigerator 1, it can be appreciated that the door 3*a* is open by an angle greater than 90°, in particular almost 150°, with respect to the front surface of the cabinet 2. In fact, the particular shape of the refrigerator 1 is such as to allow wide door opening angles, for easier access to the cell of the refrigerator itself.

As aforementioned, the refrigerator 1 comprises a flexible tubular element 11*a* (FIG. 3) that connects the cabinet 2 to further elements (not shown) comprised in the door 3*a*.

Because of the wide opening angle of the door 3*a*, the tubular element must be sufficiently flexible to follow the opening and closing movements of the door 3*a*, which cause it to flex considerably, especially in the region 5.

In the preferred embodiment, the display 4 is positioned at the centre of the door 3*a*, facing outwards from the refrigerator 1, and the flexible tubular element is arranged near the right-hand hinges of the door 3*a*.

Since it would be easy to conceive a variant of the refrigerating appliance 1 with left-hand hinges, which would change the opening direction of the door 3*a*, it is advantageous to provide an embodiment of the refrigerator 1 wherein the flexible tubular element comprises suitable electric or hydraulic connectors allowing the refrigerator 1 to be easily assembled whether it has right-hand hinges (as shown in FIG. 1) or left-hand hinges (not shown) for the door, as will be described in detail below.

Figure 3:
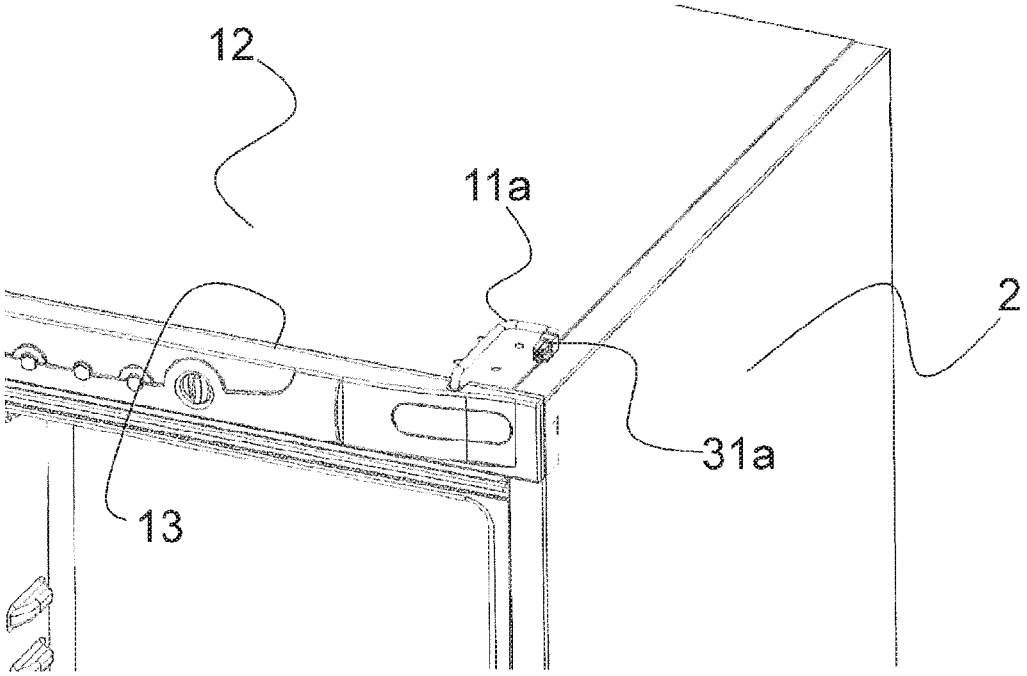
FIG. 3 shows a first section of the tubular element on the cabinet of a refrigerating appliance according to one embodiment of the present invention.

FIG. 3 illustrates a first section 11*a* of the tubular element on the cabinet 2. The flexible tubular element is preferably made up of multiple sections, whether electric, hydraulic, etc., connected together by means of suitable connection elements, such as the connection element 31*a*.

The flexible tubular element 11*a* exits through the top wall 12 of the cabinet 2, in particular through a suitable hole provided in the top wall of the front panel 13 of the refrigerator 1. The flexible tubular element also fits into suitable inner cavities (not shown) of the cabinet 2 to create the electric or hydraulic circuit for the intended purpose.

Figure 4:
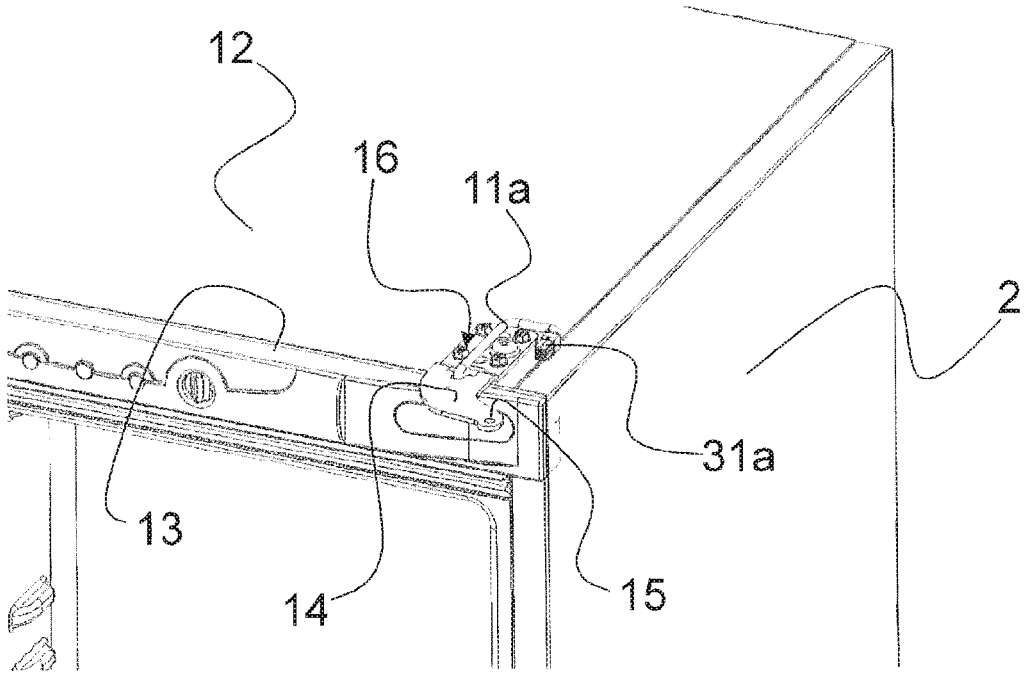
FIG. 4 shows the bracket that supports the door of the refrigerating appliance of FIG. 3.

FIG. 4 shows the bracket 14 that supports the door 3*a* in the refrigerating appliance of FIG. 3. The bracket 14 is rigidly attached to the top wall 12 of the cabinet 2, being in particular configured to support a hinge allowing the door 3*a* to rotate for opening and closing, and comprises, for this purpose, a hole 15 for the hinge. In particular, the bracket 14 is screwed to the top wall of the cabinet 2, into suitable seats that ensure the necessary structural strength of the refrigerator assembly 1.

Preferably, the bracket 14 further comprises a profiled central hole 16 for the passage of the flexible tubular element 11*a* where it exits the front panel 13, immediately above the exit hole. This provides better protection of the flexible tubular element 11*a* in this region, since the bracket 14, which is typically made of steel, cooperates with the front panel 13 to protect the flexible tubular element 11*a* against external stresses that might damage it.

Figure 5:
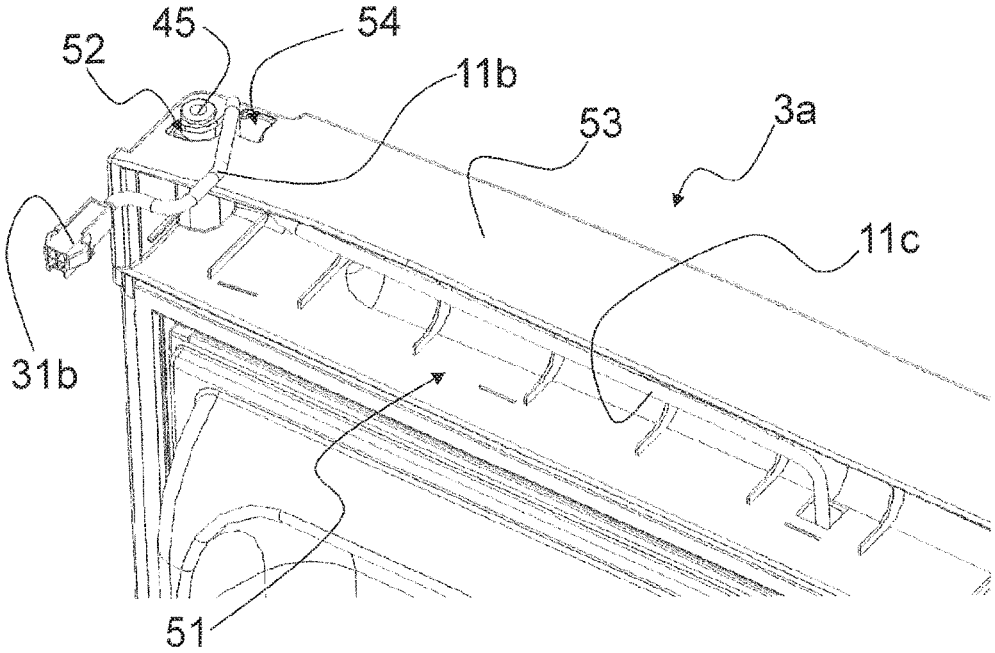
FIG. 5 shows a second section of the tubular element on the door of a refrigerating appliance according to one embodiment of the present invention.

FIG. 5 shows a second section of the tubular element 11*b* on the door 3*a*. The tubular element 11*b* comprises a connector 31*b*, which is adapted to be coupled to the above-described connector 31*a* in order to establish a connection between the two sections of the tubular element.

The tubular element 11*b* is adapted to enter the cavity 51 of the door 3*a* by passing through the slot 52 formed in the top wall 53 of the door 3*a*.

The slot 52 partially surrounds the hole 45 of the hinge, which is exploited in order to establish a hinged connection with the hole 15 of the above-described bracket 14.

In particular, the slot 52 has a semi-annular shape and comprises a recess 54 adapted to allow the passage of the connector 31*b* while assembling the refrigerator 1. In other words, the recess 54 is slightly bigger than the connector 31*b*, thus allowing the latter to pass through the top wall 53. In a preferred embodiment, the dimensions of the connector 31 (not including the dimension in the direction of the length of the element 11*b*) are 10.0×15.0 mm, and the dimensions of the recess 54 are 12.0×17.0 mm.

Alternatively, a variant embodiment may be conceived wherein the dimensions of the slot 52 are such as to allow the connector 31*b* to pass through.

Furthermore, the section of the tubular element 11*c* in the slot 52 preferably reaches the central region of the cavity 51, and its length is such as to allow mounting the flexible tubular element on both sides of the door 3*a*, as will be further described below, thus allowing the reversal of the opening direction of the door 3*a*.

Figure 6:
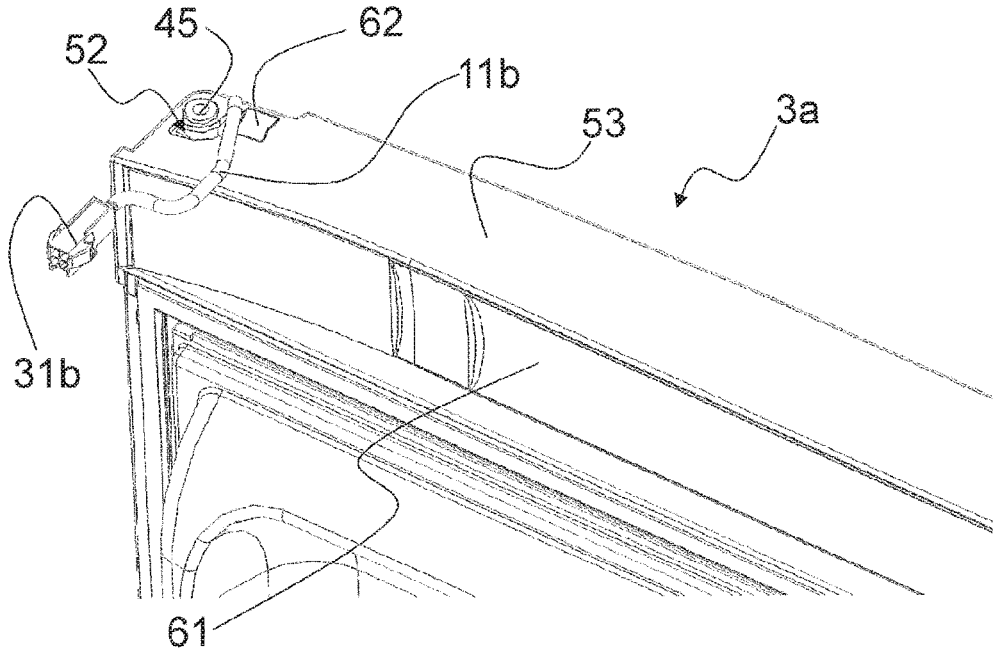
FIG. 6 shows suitable covers for the door of FIG. 5.

FIG. 6 shows a first cover 61 for covering, for aesthetic and protective purposes, the cavity 51 of the door 3*a*, and a second cover, i.e. the small aesthetic plate 62, adapted to fit over the recess 54 to cover the area thereof, leaving only the slot 52 uncovered.

The slot 52, which preferably has a semi-annular shape, has a channel width dimension, or a size in general, that is slightly greater than the diameter of the flexible tubular element 11*b*; in this manner, better guidance is provided while opening and closing the door 3*a*, since the flexible tubular element 11*b* is allowed to make small settling movements that facilitate the opening and closing operations and reduce the risk of undesired stresses acting upon the flexible tubular element 11*b* or the connectors 31*a* and 31*b*.

Figure 7:
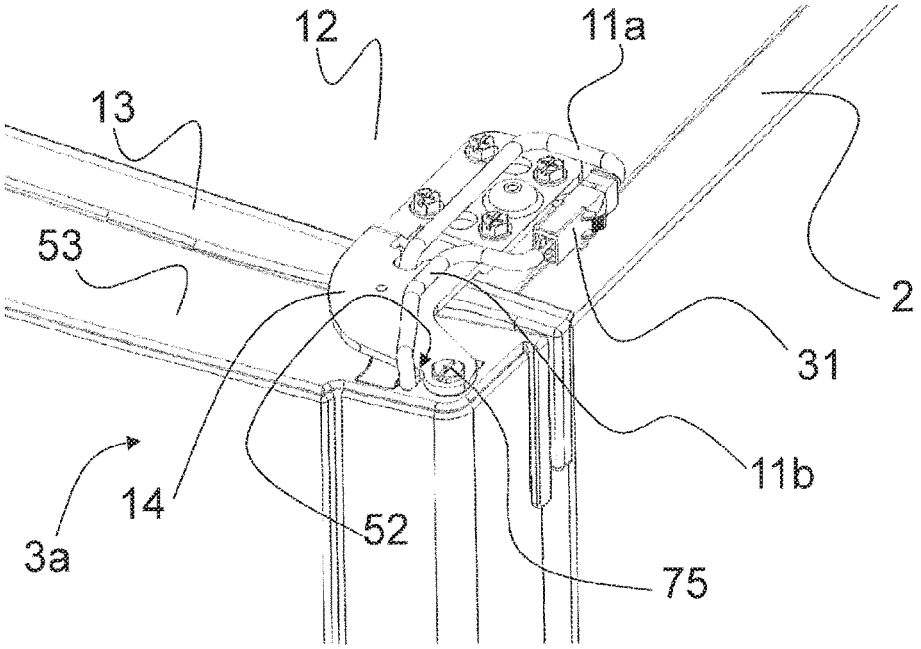
FIG. 7 shows in detail a solution for guiding a tubular element in a refrigerating appliance according to the present invention, in the closed door configuration.

FIG. 7 illustrates the door 3*a* closed and coupled to the cabinet 2 by means of a hinged connection 75 that allows turning the door 3*a* for opening or closing it. The hinged connection 75 is preferably provided by a suitable screw which is set into the hole 45 after the hole 15 of the bracket 14 has been engaged between the door and the head of the screw itself.

Moreover, the connectors 31*a* and 31*b*, designated by reference numeral 31, are connected to each other.

As shown in FIG. 7, when the door is closed the slot 52 is partially under the bracket 14; in particular, the portion of the slot 52 that remains uncovered by the bracket 14 is the one occupied by the section of the tubular element 11*b* exiting through the top wall 53 of the door 3*a*.

When the door is closed, the slot 52 is located, therefore, in the region comprised between the hinge 75 and the cabinet 2.

Figure 8:
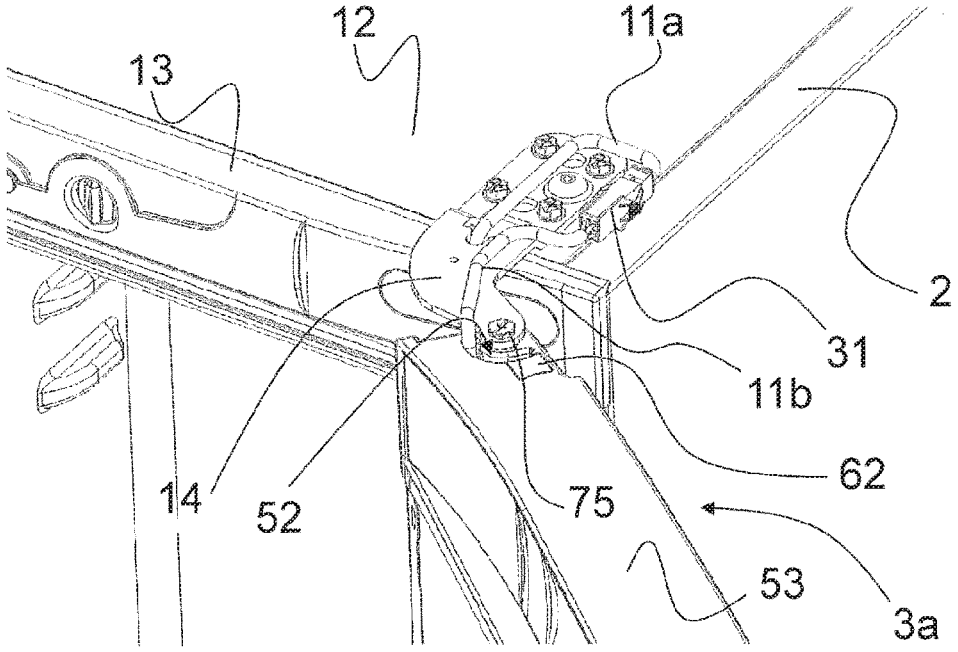
FIG. 8 shows in detail the solution for guiding a tubular element in a refrigerating appliance of FIG. 7, in the open door configuration.

FIG. 8 illustrates the elements of FIG. 7 when the door 3*a* is open.

When the door 3*a* is open, the slot 52 is in the region external to the hinge 75, with respect to the position of the cabinet 2. In other words, as the door 3*a* is opened the flexible tubular element 11*b* slides within the slot 52, guided by the edges of the latter; in this manner, it follows a semi-circular trajectory in the channel of the semi-annular slot 52, thus allowing wide opening angles of the door, greater than 90° or, preferably, greater than 150°.

It must be pointed out that other shapes of the slot 52, although less advantageous than the preferred embodiment thereof exemplified herein, would still provide guidance of the tubular element 11*b*.

In particular, in some preferred embodiments the slot 52 has a semi-annular profile, i.e. equal to a circular sector of a circle ring, or other similar shapes. The slot 52 is preferably arranged around the hinge 75, particularly around the axis of rotation thereof.

Preferably, the width of the channel of the slot 52, i.e. its size in general, is such as to allow the flexible tubular element 11*b* to move unhindered along the direction of development of the slot 52. In a preferred embodiment, the flexible tubular element 11*b* has a diameter of 5.0 mm, and the width of the channel of the slot 52 is 6.5 mm.

The semi-annular slot 52 preferably occupies a circular sector of approximately 90°, between the front wall of the door 3*a* and the side wall of the same door 3*a*, on the top surface 53. Since the flexible tubular element can slide axially to some extent in and out of the slot 52, the opening angle of the door exceeds 90°, and may even reach 150° or more.

As shown in FIGS. 7 and 8, the bracket 14 is substantially flat and is configured to be surmounted by the flexible tubular element 11*b* and crossed by the same before it enters the slot 52. This provides better guidance of the flexible tubular element 11*b* along its path, facilitating the opening and closing of the door 3*a* and reducing the risk of damage to the flexible tubular element 11*b* itself.

In addition, the flexible tubular element 11*a* is configured to form a bend over the top wall 12 of the cabinet 2, in particular facing towards the rear of the same. In this manner, the connector 31 is easily accommodated in said bend, and the flexible tubular element 11*a* is subject to less stress while opening and closing the door 3*a*. In fact, the curvature of the flexible tubular element 11*a* is imposed by the shape of the bend thus configured, and will not exceed the desired design limits.

Figure 9:
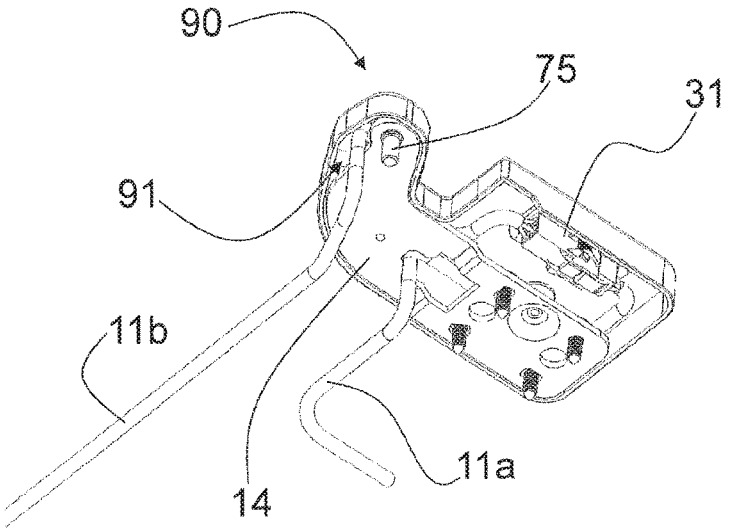
FIG. 9 shows a detailed bottom view of the solution for guiding a tubular element in a refrigerating appliance according to the present invention.

FIG. 9 shows the bracket 14, the flexible tubular element 11*a* and 11*b*, the connector 31, and the bracket 75, separated from the refrigerator 1 and assembled together with an aesthetic cover 90, which comprises a profiled shell configured to accommodate therein the flexible tubular element. The aesthetic cover 90 is further configured to be coupled to the bracket 14, leaving however a clear portion 91 for the passage of the flexible tubular element 11*b* in the region facing towards the door 3*a*.

In general, the surfaces of the aesthetic cover 90 are so shaped as to allow the flexible tubular element 11*b* to slide at least partially, so that it can still make small settling movements which are necessary during the opening and closing actions of the door 3*a*.

Furthermore, the aesthetic cover 90 may comprise suitable internal ribs (not shown) that allow the elements, in particular the flexible tubular element, to be secured therein in the configuration shown in FIGS. 7 and 8, so that the movement of such elements will not hinder the opening and closing movements of the door 3*a*. In general, the surfaces of the aesthetic cover 90 have smoothed edges that will not damage or cut the flexible tubular element.

Appropriate clearances are allowed between the various mobile elements to ensure that the door 3*a* will open and close accurately, without encountering any obstacles or resistance which might jeopardize the integrity of the system.

Likewise, appropriate clearances and tolerances allowing the door to open and close properly will also have to be provided in the cabinet 2, along the path of the flexible tubular element; such clearances will have to be determined on the basis of specific design choices and, most importantly, of the flexibility and durability of the tubular element.

Figure 10:
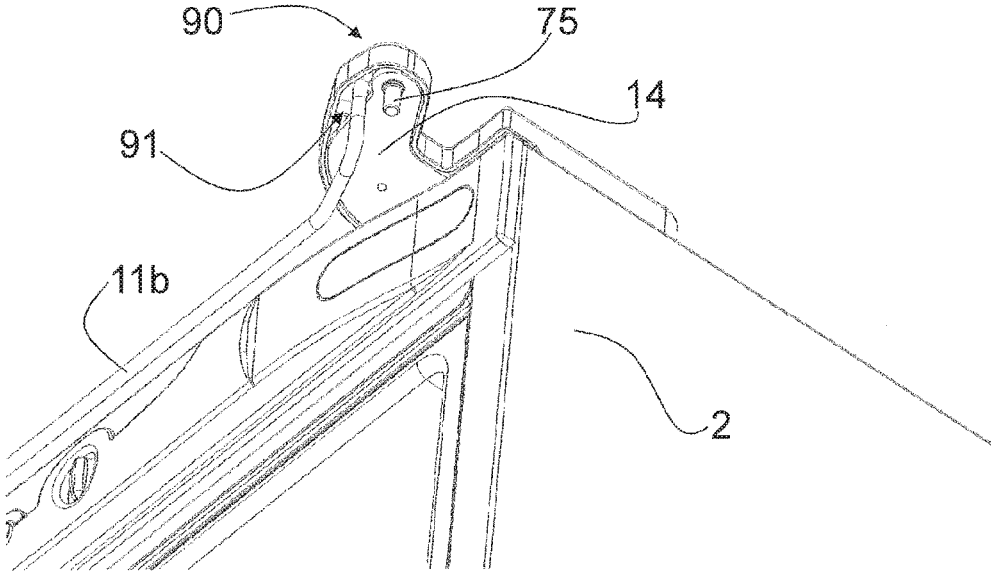
FIG. 10 shows the detail of FIG. 9, positioned on top of the cabinet of a refrigerating appliance.

In FIG. 10, which illustrates the aesthetic cover 90 positioned on top of the cabinet 2, one can better appreciate the clear portion 91 of the same, for the passage of the tubular element 11*b* in the region facing towards the door.

Figure 11:
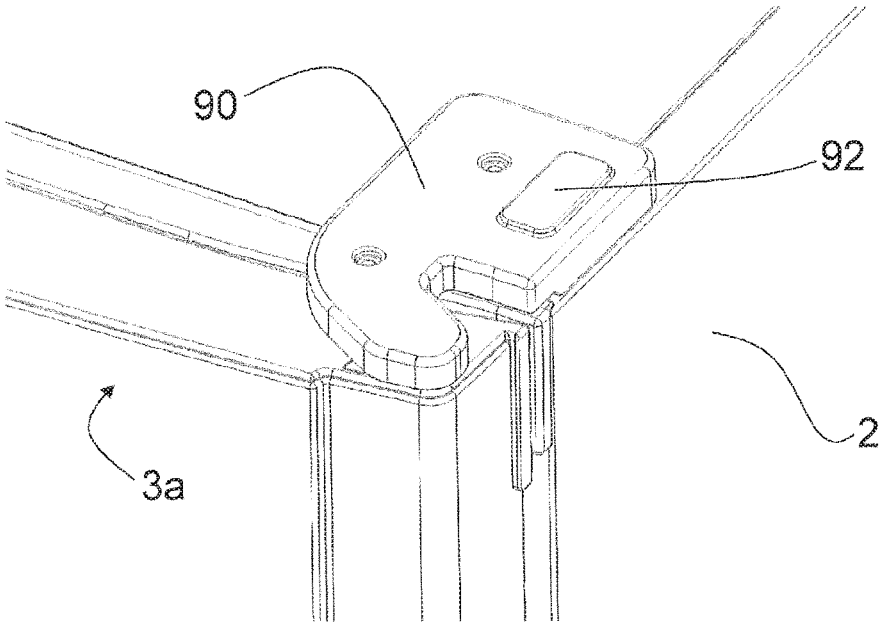
FIG. 11 shows a detailed top view of the solution for guiding a tubular element in a refrigerating appliance according to the present invention, with its aesthetic cover.

FIG. 11 is a top view of the aesthetic cover 90, within which the tubular element 11*a* and 11*b* is guided as previously described. This Figure shows a protrusion or boss 92 that preferably houses the connector 31, holding it in a predetermined position.

In general, a refrigerator according to the present invention, once it has been assembled, has no tubular element section in view, to advantage of the appearance of the household appliance.

Preferably, the aesthetic cover 90 is made of plastic material, whether as one piece or comprised of a plurality of elements assembled together, e.g. by fitting, welding or glueing.

As aforementioned, a refrigerator according to the present invention may be equipped with a door 3*a* comprising hinges on the right side of the cabinet 2, as shown, or it may be equipped with a different door comprising hinges on the left side of the cabinet 2, depending on the user's requirements and the available room. It is therefore advantageous to offer, in this respect, the possibility of making the door of the refrigerating appliance "reversible".

It is therefore apparent that, in order to change the door configuration, e.g. from "right-hand" hinges to "left-hand" hinges", it will also be necessary to modify the path of the flexible tubular element.

The refrigerator door according to a particular embodiment of the present invention may offer significant advantages in a situation wherein "reversibility" of the refrigerator door is needed.

For this purpose, a door like the one shown in FIG. 2 comprises respective slots 21 also on the side not engaged with the hinges in the region 5, which are also provided on the top wall of the door 3*a*. In other words, the top wall of the door 3*a* comprises slots on both the left and right sides, so as to allow the opening direction of the door 3*a* to be reversed by differently mounting the flexible tubular element.

In a preferred embodiment, aiming at simplifying the assembly of the refrigerator and the reversal of the door opening direction, the flexible tubular element comprises suitable connectors 31*a* and 31*b*, as already described. In particular, it is advantageous that the flexible tubular element comprises connectors which have such shapes and are arranged in such positions as to allow the flexible tubular element to run, without distinction, on the left side or on the right side of the cabinet. For example, the length of the flexible tubular element may be such as to reach apertures located on the right or left side of the top wall of the door, depending on the side whereon the door hinges are positioned.

As already described, the flexible tubular element originates from a cavity formed behind the upper front panel 13 of the cabinet 2, sliding within a profile and reaching the hinges of the door 3*a* (on the right side or, if necessary, on the left side), and then ending into the door 3*a* and establishing the above-described desired connection.

Likewise, the flexible tubular element may follow different paths, on either the left side or the right side of the door 3*a*, within the cavity 51 of FIG. 5, its length being such as to allow it to be reversed on the other side.

In the light of the above description of some preferred and advantageous embodiments of the present invention, it will be apparent to the man skilled in the art that the invention may be subject to further modifications and variations.

For example, refrigerating appliances may be conceived which comprise a plurality of flexible tubular elements connecting the doors to the cabinet.

In general, the present invention has been described herein with reference to a refrigerator comprising two doors and two cells. However, this example is not limiting, since the invention may be successfully applied to refrigerating appliances comprising just one cell, just one door, or any number of cells and doors.

The invention claimed is:

1. A refrigerating appliance comprising:

a cabinet having a top wall, side walls, and a rear wall;

a door having a top wall and a cavity;

a hinge connected to a hole in the top wall of the door and allowing the door to rotate about an axis for opening and closing;

a bracket supporting the hinge;

a flexible tubular element having a connector attached to the flexible tubular element, the flexible tubular element inserted on one side in the cabinet and on a second side in the door;

a slot having a semi-annular shape and formed in the top wall of the door, the semi-annular shape of the slot arranged around the hole for the hinge and discontinuous with the hole for the hinge, the slot having a recess configured such that the connector will pass through the recess, and the slot being partially under the bracket when the door is closed; and wherein the flexible tubular element passes through the top wall of the door through the slot and enters the cavity of the door.

2. A refrigerating appliance according to claim 1, wherein:

the slot extends from a region between the hinge and the cabinet when the door is closed, to a region external to the hinge with respect to the cabinet when the door is open.

3. A refrigerating appliance according to claim 1, wherein:

the hinge is attached to the top wall of the door;

the slot has the semi-annular profile and is arranged around the hinge;

the slot having a width such as to allow the flexible tubular element to move along the semi-annular profile;

and the width of the slot being greater than a diameter of the flexible tubular element.

4. A refrigerating appliance according to claim 1, wherein:

the bracket is rigidly attached to the top wall of the cabinet;

the bracket being substantially flat and configured to be surmounted by the flexible tubular element;

and the flexible tubular element runs over the bracket and crosses the bracket before entering the slot.

5. An appliance according to claim 4, wherein:

the bracket further comprises a profiled hole configured to allow the flexible tubular element to pass through the profiled hole while exiting the top wall of the cabinet, at an upper front panel of the cabinet.

6. A refrigerating appliance according to claim 4, wherein:

the flexible tubular element is configured to form at least one bend over the top wall of the cabinet at the bracket, towards the rear wall of the cabinet with respect to the door;

the flexible tubular element comprises the connector that connects together two sections thereof; and the connector being configured to be placed in the at least one bend.

7. A refrigerating appliance according to claim 4, further comprising:

an aesthetic cover for the bracket, the aesthetic cover being shell-shaped and configured to receive a section of the flexible tubular element, wherein the aesthetic cover is further configured to be coupled to the bracket, thereby creating a free passage for the flexible tubular element in a region where flexible tubular element enters the slot.

8. A refrigerating appliance according to claim 1, wherein:

the flexible tubular element comprises the connector, which connects together two sections thereof;

the slot further comprises the recess adapted to allow passage of the flexible tubular element and the connector during assembly of the refrigerating appliance; and the recess being covered by an aesthetic plate.

9. A refrigerating appliance according to claim 1, wherein:

the door further comprises a second slot on the top wall of the door, the slot and the second slot are on left and right sides of the door, respectively, so as to allow an opening direction of the door to be reversed by differently mounting the flexible tubular element.

10. A refrigerating appliance according to claim 1, wherein:

the flexible tubular element comprises at least one of a pipe for a liquid or a sheath for at least one electric cable.

* * * * *